United States Patent [19]

Stanford

[11] Patent Number: 4,480,775

[45] Date of Patent: Nov. 6, 1984

[54] FRONT PACK

[76] Inventor: Lamarr O. Stanford, 1500 Merivale Rd., Ottawa, Ontario, Canada, K2C 3G6

[21] Appl. No.: 431,244

[22] Filed: Sep. 30, 1982

[51] Int. Cl.[3] ..... A45F 3/10

[52] U.S. Cl. ..... 224/210; 224/161; 224/261; 224/270; 224/211

[58] Field of Search ..... 224/210, 158, 159, 160, 224/161, 211, 270, 261, 262, 211

[56] References Cited

U.S. PATENT DOCUMENTS

| | | | |
|---|---|---|---|
| 169,384 | 5/1916 | Munroe . | |
| 188,125 | 1/1919 | Yergason . | |
| 237,578 | 2/1924 | Oliver . | |
| 239,130 | 4/1924 | Stenagaard et al. . | |
| 2,566,464 | 9/1951 | Redenback | 224/261 |
| 2,822,117 | 2/1958 | Mack | 224/161 |
| 2,967,649 | 1/1961 | Mack | 224/270 X |
| 4,307,826 | 12/1981 | Stewart | 224/211 X |

FOREIGN PATENT DOCUMENTS

| | | |
|---|---|---|
| 688912 | 6/1964 | Canada . |
| 950431 | 7/1974 | Canada . |
| 1123796 | 5/1982 | Canada . |
| 1215795 | 12/1960 | France . |

*Primary Examiner*—Steven M. Pollard

*Attorney, Agent, or Firm*—Burns, Doane, Swecker & Mathis

[57] ABSTRACT

A pack frame for wearing on the front of a person for supporting a mail bag or other container is provided having a pair of vertical standards, a top bar and a bottom bar integrally connecting the standards and a U-shaped bar integrally extending at its ends from the vertical standard in a horizontal plane. The bag is supported on the frame so that it rests on the U-shaped extending horizontal bar.

10 Claims, 7 Drawing Figures

Fig. 1
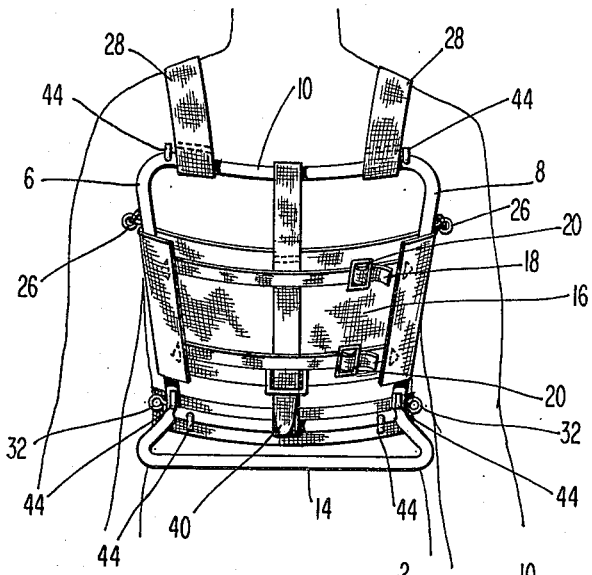
Fig. 2
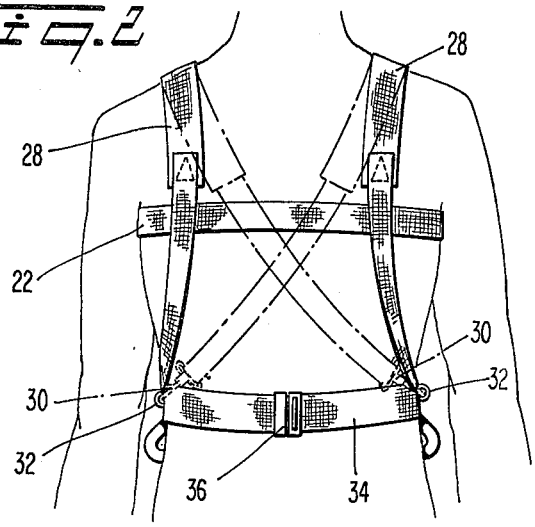
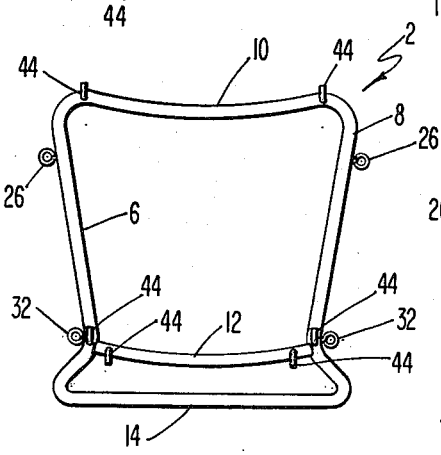
Fig. 3
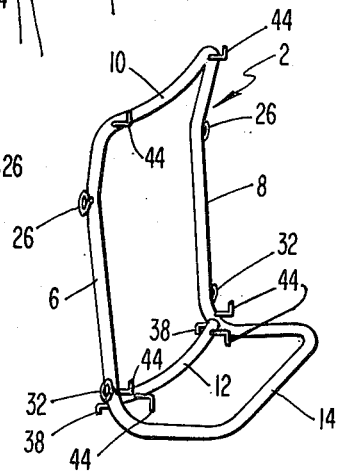
Fig. 4
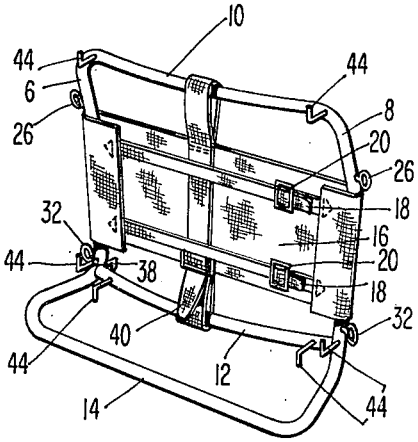
Fig. 5
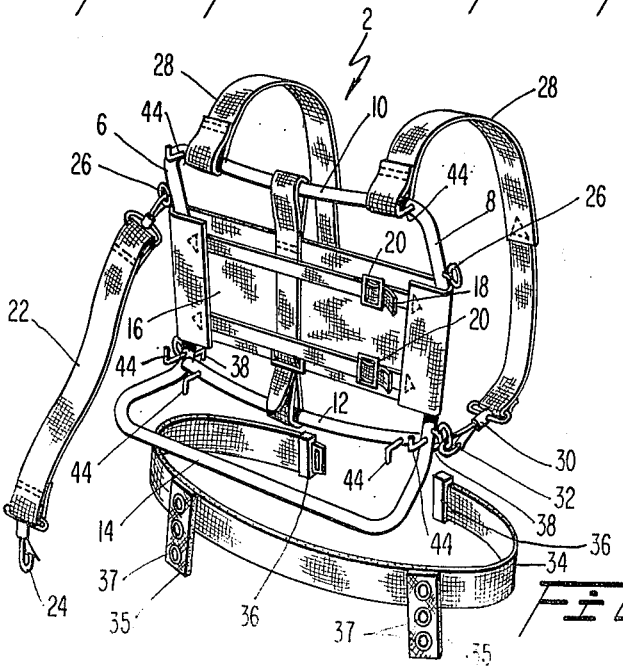
Fig. 6
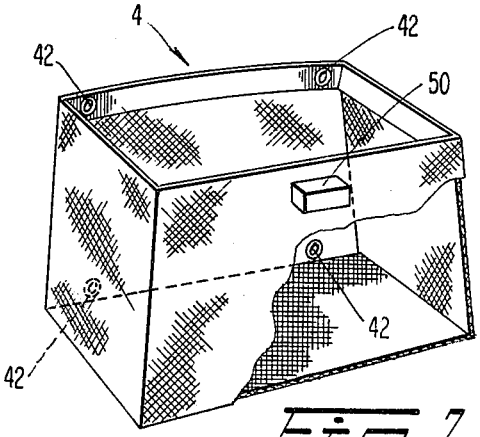
Fig. 7

FRONT PACK

BACKGROUND OF THE INVENTION

The present invention relates to a device for carrying heavy bulk items such as mail, fruit, and the like.

Mail personnel, fruit pickers and similar persons required to carry heavy bulk loads, of separable or large particulate items, have employed large sacks or bags slung over one shoulder. Such sacks or bags have been deemed most convenient since it is necessary for the person to have relative freedom of hand and arm movement, and must have ready access to the mouth of the bag for the quick insertion and/or removal of the items carried or to be carried.

Recently, however, the harm to the physical well being of the person carrying such sacks or bags has reached a point where it has become a serious problem. The weight of a mail bag, fully loaded, ranges between 35–50 lbs., and the bag must be carried for long distances and/or extended periods of time. Similarly, fruit pickers bags and the like are heavily loaded and must be carried over long periods. As a result, large numbers of carrier personnel have been afflicted with severe, othopedic as well as internal functional disorders arising from the prolonged use of the conventional bags.

Serious consideration has been given to replacement of the bags with hand pushed carts, small carrying vehicles and the like. However, none of these substitute attempts is entirely satisfactory, since they give rise to other problems. Firstly, these alternatives are costly; secondly, not all carriers can operate mechanical devices efficiently; thirdly, such mechanical devices are not suitable over rough terrain in foul weather, particularly in the snow; and, in particular with respect to mail carriers, cannot be driven or taken directly to the door or mail drop of the customer. As a result, these alternatives are not in wide favor.

It is therefore an object of the present invention to provide apparatus for carrying loads such as mail, fruit and the like which effectively overcome the above disadvantages.

It is particularly an object of the present invention to provide a frame and bag combination which can be worn on the front portion of a person's body, distributing the weight of the bag on the trunk of the body and in particular on those portions of the trunk sturdiest and strong enough to bear such excessive weight over long periods of time while enabling the wearer to have free use of his arms, as well as his legs.

Frames for bags or packs have been known and widely used in the form of back packs by hikers and the like. Such back packs are not at all suitable for mail personnel or for fruit pickers since they do not allow easy access. Secondly, back packs are designed to place the load mainly on the shoulders of the wearer, thus not avoiding the inherent problem with the conventional mail or fruit sack or bag.

It is nevertheless an object of the present invention to provide a novel frame for holding and supporting a carrying bag, which frame can be worn on the front portion of the body of the user, and which enables a more advantageous distribution of weight and force than one would have expected from a back frame.

It is yet another object to provide a combined frame and pack which enables the user to have complete mobility for walking, arm use, bending and the like.

The foregoing advantages together with other objects and advantages will be seen further from the following disclosure of the present invention.

SUMMARY OF THE INVENTION

According to the present invention, a pack for wearing on the front of person for supporting a bag or other container is provided which includes a frame having a pair of spaced vertical standards, a top bar and a lower bar integrally connecting the standards and a U-shaped bar integrally extending at its ends from the lower ends of the vertical standards in a horizontal plane. Strap means are provided for securing the frame on the front of a wearer's torso such that the weight of the assembly is at least partially carried by the wearer's hips. A bag or the like is supported on the frame so that the bag rests on the U-shaped extending horizontal bar.

The frame is preferably made of aluminum, or similar light weight but strong metals. It may be covered with plastic, if desired.

It is preferable, although not essential, that the wearer use a hip belt or waist band, which may be padded in the area of the wearer's stomach, having means for engaging with attachment members, such as hooks, provided on the lower sides of the vertical standards, such that a substantial part of the weight of the assembly is carried by the wearer's hips, and thus in turn by the wearer's legs. The frame can also be provided with a back strap situated so that it crosses the wearer's back below the arm pits. The weight of the frame and bag is such that the torque on the frame is mostly overcome by this back strap and acts or reacts by pressing the lower bar into the pit of the wearer's stomach.

The frame may also be provided with one or a pair of shoulder straps for added security and comfort.

The bag is generally open at its top, and is preferably provided with grommets or other suitable fastening members which cooperate with fastening members associated with the frame so that the bag is easily attachable to or removable from the frame.

The frame can also be provided with an adjustable length strap extending from about the midpoint of the top bar and havinhat it extends at most from the shoulders to the waist so that the wearer can easily bend, and have complete freedom of arm and leg movement.

Full details of the present invention are set forth in the following disclosure and are illustrated in the accompanying drawing.

BRIEF DESCRIPTION OF THE DRAWINGS

In the drawings:

FIG. 1 is a front perspective view of a person wearing a pack frame formed according to the present invention, FIG. 2 is a view of the person from the rear, FIG. 3 is a perspective view of the frame of the present invention, FIG. 4 is a side view of the frame shown in FIG. 3, FIG. 5 is a perspective view of the frame of FIG. 3 illustrating a portion of the webbing and straps employed with the frame, FIG. 6 is a view similar to FIG. 5 showing the complete frame and cinch employed therewith, and FIG. 7 is a perspective view of a bag which may be employed with the frame shown in FIGS. 1–6.

DESCRIPTION OF THE INVENTION

As seen from the drawings, the frame and bag of the present invention comprise as seen in FIG. 1 a frame, generally depicted by the numeral 2, adapted to be worn over the chest and stomach of the user on which is supported a bag 4, such as shown in FIG. 7.

The frame 2 comprises a pair of spaced side standards 6 and 8 of identical length, both slightly bowed outwardly from the user about midway of their length. A top cross bar 10 joins side standards adjacent their upper ends, and a lower cross bar 12 joins the side standards at their lower end. Either or both the top and lower cross bars can be bowed slightly to provide a more formfitting shape. It is preferred that the side standards 6 and 8 curve smoothly into the integral top cross bar 10, as shown in the drawings, such that any contact with a wearer's upper arms is minimized during use.

Extending horizontally from substantially the lower ends of the side standards is a U-shaped bar 14. The U-shaped bar 14 is preferably formed integrally, that is as a unitary extension of the side standards so as to permanently be rigid with respect thereto. The U-shaped horizontal bar 14 thus forms a shelf horizontal to the ground when the pack is worn.

The overall width of the frame may vary, but the distance between side standards 6 and 8 should be approximately the width of the user's body and the length from top cross bar 10 to shelf 14 should be approximately from chin level (slightly below shoulder level) to pelvic joint level. This will provide most comfortable wear, and enable the user to have free arm movement and freedom to stoop or bend. Since the adult human body varies in only small detail over the trunk area, a standard size can be employed or only a small number of standard sizes such as small, medium or large can be made.

To enable the frame to be worn most easily, the frame is provided with a webbing member 16, (see FIG. 5) secured over the side standards 6 and 8 and extending in one continuous piece over the back of the frame. It must at least extend completely over the back of the frame so that it rests or bears primarily against the stomach and chest of the user, whereby the weight of the frame and its load can be pressed over a large area of the front of the wearer's torso as a result of the outward bowing of the top and lower bars. The webbing 16 can be secured by a pair of straps 18 fastened by buckles 20 so that the tension on the webbing can be easily adjusted.

A back strap 22, is secured at one end to the side frame 6 or 8 and is adapted to extend around the back of the user as seen in FIG. 2, just beneath the arm pits. The back strap is provided with an adjustment buckle and snap closure 23 and is removably fastened to a hook or eye 26 associated with the opposite side standard. The back strap 22 is preferably adjustable so that it can be lengthened or shortened to provide the particular wearer with sufficient force to clamp the frame, by reaction to it, to the front of the wearer's torso without sag or play.

A pair of shoulder straps 28, of adjustable length, can also be provided, each being secured at one end to the top cross bar 10 near the respective side standards, and being provided with snap fasteners 30 securable to eyes or loops 32 at the loser end of the side standard. The shoulder straps may be worn parallel to the user's side as shown in full lines or crossed over as shown in dotted lines in FIG. 2.

Preferably, the fasteners for the back strap and the shoulder straps are of the type which can be easily manipulated with the use of only one hand, since when the frame is mounted on the user, the user will be unable generally to cross his arms over from one side to the next. Snap fasteners serve this end, although lanyard fasteners or the like, all commonly known, may also be used.

The frame is also preferably employed with a separable waist band 34, see FIG. 6, comprising a wide belt of strap material, preferably padded with material such as foam rubber or plastic. The waist band 34, is fastened by a buckle 36 so that it rests on the hip. Since, as indicated before, once the frame is put on by the user, he will have only limited ability to cross his arms, the waist 34 is therefore generally put on first. Of course, in use the buckle 36 is placed on the back of the user so that the full passing opposes the lower cross bar 12 during use. The frame 2 carries a pair of hooks 38 which are adapted to fit into selected recesses 37 carried by straps 35 which are attached to the cinch. The waist band 34 is preferably provided with appended straps 35 having attachment means, such as grommets 37, which accept attachment means, such as hooks 38, provided on the lower sides of the vertical standards 6 and 8, such that the frame can be essentially suspended from the waist band 34.

The waist band allows the bottom bar to seat firmly against the stomach of the user and when the frame is loaded, absorbs the weight and force of the frame not absorbed by the chest. In fact, all of the torque force is absorbed in the area of the waist band. Lastly, if desired, the frame may be provided with a vertical belt 40 extending between the top and lower cross bars 10 and 12. This will strengthen the webbing 16 at its midsection.

The bag 4 such as a mail bag, fruit bag, or the like is hung directly on the frame. To this end, the bag 4 of generally rectangular polyhedral shape is provided with fastening members, such as grommets or eyes 42, at its upper rear corners as well as at its lower rear corners. The frame 2 is provided with corresponding fastening members 44 adjacent the upper and lower extremes of the standards 6 and 8. The bag is thus easily removably attached to the frame and the weight thereof, loaded or unloaded, transmitted to the frame. By placing attachment members on the frame just above the shelf 14, the bottom wall of the bag rests on the shelf, such that when loaded, the bag is supported on the shelf and does not hand pendulously.

To keep the bag, when loaded with mail or other objects, from distending, i.e., having its front wall pull away from the frame, the frame is provided with a belt 46, attached to the upper bar. The belt 46 is provided with a snap fastener 48 which engages with a mating fastener 50 secured on the front wall of the bag. The belt 46 thus extends over the top of the bag holding the front wall in place. Of course, the belt 46 may be adjustable.

The webbing 16, shoulder straps 28 as well as any of the belts 22, 38 or 40 can be padded for comfort and/or covered for strength and weather or wear resistance. It will also be obvious that since the torque is absorbed mostly by the waist band 34, the user may desire not to employ or wear one or more of the shoulder straps, or back straps as desired, or any combination of these elements, without too much detriment.

With the pack worn as indicated, the user's arms are free to enter the bag, remove its contents and deliver the removed contents with a great deal of freedom. Further, the shelf 14 prevents the bag from sagging, allowing the user to bend freely and easily, to sit comfortably, or to walk up steep inclines without the bag touching the thighs.

As seen from the foregoing a front mounted carrier is provided which is easily secured to a person and is held adjacent the upper abdomen and lower chest. The stiffened frame acts to support a container sack which will hold the objects to be carried. The bag transmits all its weight to the frame before the frame in turn transmits the weight to the body of the wearer. The frame can transmit the weight to the wearer at either or both waist level and at shoulder level. The weight of the front pack can be transferred to the wearer by means of a padded waist belt from which the pack is suspended so as to distribute weight to the hips and/or by padded straps which extend over the wearer's shoulders and/or around the back and reattach to the front pack at the side of the person's body. The frame comprises spaced substantially vertical parallel side elements adapted to be disposed on each side of the front of the torso of the wearer. Webbing is provided which forms a loop in horizontal fashion around these two vertical elements. This webbing may be adjustably tightened so as to be variably taut. When the frame is strapped to the wearer, the webbing exerts a force on the front of the torso of the carrying person so that the bag carried by the frame can be held slightly away from the wearer, thus permitting air circulation therebetween. The forwardly disposed horizontal shelf will tend to keep the bag from sagging toward the wearer when it is filled. When the front pack is attached to the wearer the horizontal shelf is positioned above the wearer's legs when the wearer squats down to pick up an article.

The shoulder straps can be adjusted so as to reduce the weight carried by the waist band. In the event that it is desired to carry no weight on the shoulders of the wearer, the shoulder straps can be completely removed whereupon all the downward weight of the front pack is suspended from the waist band. In that configuration one would still be required to use the horizontal strap which would be connected from the top of one of the parallel side elements of the frame and disposed behind the back of the wearer to where it would be removably connected by an attachment member to the top of the other parallel side element of the frame. The purpose of this strap would be to counteract the torque acting on the front pack produced by the weight of the pack tending to cause the pack to rotate downwardly about the waist band attachment points.

Various changes and modifications have been suggested, and others will be obvious to the reader. Therefore, it is intended that the present disclosure be taken as illustrative only and not as limiting of the invention.

What is claimed is:

1. A pack adapted to be worn on the front of a wearer to support an upwardly open container to which ready access by the wearer must be had, said pack comprising:

a frame to which the container is to be secured and comprising:

an upright portion including a pair of generally vertical standards and upper and lower bar means interconnecting said standards, and a forwardly projecting portion including a support bar projecting forwardly from said upright portion adjacent said lower bar means for supporting the bottom of the container from beneath, a cinch adapted to be worn about the waist of the wearer and including a padded front portion, said cinch and said frame carrying releasable connecting means for supporting said frame such that said upper bar means is situated above the wearer's stomach and below the wearer's shoulders, and said lower bar means is situated at the wearer's waist in front of said padded front portion of said cinch, and said support bar is disposed at about the wearer's waist, securing means for securing said frame on the front of the wearer's torso and including:

first strap means securable to said frame and extendable around the upper back of the wearer, and second strap means securable to said frame and extending over at least one shoulder of the wearer.

2. A pack according to claim 1, wherein said releasable connecting means comprise projections on one of said frame and cinch and recesses on the other of said frame and cinch.

3. A pack according to claim 2, wherein said recesses are disposed at a plurality of heights in strips carried by said cinch.

4. A pack according to claim 1, wherein said releasable connecting means comprises a pair of first connectors projecting sidewardly adjacent a lower end of said frame, said first connectors being situated no farther rearwardly than said upright portion of said frame.

5. A pack according to claim 4, wherein said first connectors comprise downwardly pointing hooks, and said second connectors comprise recesses for receiving said hooks.

6. A pack according to claim 1 including a webbing extending across the back of said upright portion of said frame, and means for adjusting the tension on said webbing to vary the spacing between a back of the container and the wearer's front torso.

7. A pack adapted to be worn on the front of a wearer to support an upwardly open container to which ready access by the wearer must be had, said pack comprising:

a frame to which the container is to be secured and comprising:

an upright portion adapted to bear against the front torso of the wearer, a forwardly projecting portion projecting forwardly from a lower end of said upright portion for supporting a bottom of the container from beneath, and a pair of first connectors projecting sidewardly adjacent a lower end of said frame, said first connectors being situated no farther rearwardly than said upright portion, a cinch adapted to be worn about the waist of the wearer and including a front portion carrying a pair of second connectors for being connected to said first connectors to mount said frame on said cinch, and strap means connected to said frame and adapted to extend behind the back of the wearer for securing the frame to the front of the wearer's torso.

8. A pack according to claim 7, wherein said first connectors comprise downwardly projecting hooks, and said second connectors comprise recesses carried by said cinch.

9. A pack according to claim 8, wherein said recesses are disposed at a plurality of heights in strips carried by said cinch.

10. A pack adapted to be worn on the front of a wearer to support an upwardly open container to which ready access by the wearer must be had, said pack comprising:

a frame to which the container is to be secured and comprising:

an upright portion arranged to bear against the front torso of the wearer and having upper and lower ends bowed forwardly away from the wearer relative to an intermediate portion of said upright portion, a forwardly projecting portion extending forwardly from a lower end of said upright portion for supporting a bottom of the container from beneath, a cinch adapted to be worn about the waist of the wearer, said frame and said cinch including interconnectible securing means for securing said frame to said cinch, a webbing extending across the back of said upright portion of said frame, and means for adjusting the tension on said webbing to vary the spacing between a back of the container and the wearer's front torso.

* * * * *